US005234238A

United States Patent [19]

Takimoto

[11] Patent Number: 5,234,238

[45] Date of Patent: Aug. 10, 1993

[54] RATCHET TYPE LATCH ASSEMBLY

[75] Inventor: Kazuhide Takimoto, Tokyo, Japan

[73] Assignee: Takigen Manufacturing Co., Ltd., Tokyo, Japan

[21] Appl. No.: 905,763

[22] Filed: Jun. 29, 1992

[30] Foreign Application Priority Data

Sep. 26, 1991 [JP] Japan ..... 3-274854

[51] Int. Cl.[5] ..... E05C 3/26

[52] U.S. Cl. ..... 292/216; 292/DIG. 31; 292/DIG. 43

[58] Field of Search ..... 292/216, 217, 221, 241, 292/341.18, DIG. 43, DIG. 31

[56] References Cited

U.S. PATENT DOCUMENTS

| | | | |
|---|---|---|---|
| 2,243,772 | 5/1941 | Peltier | 292/221 X |
| 2,767,007 | 10/1956 | Burke | 292/341.18 X |
| 3,664,698 | 5/1972 | Stropkay | 292/216 X |
| 3,695,659 | 10/1972 | Gionet et al. | 292/216 |
| 3,697,105 | 10/1972 | Marx | 292/216 |
| 3,796,076 | 3/1974 | Miyabayashi et al. | 292/DIG. 43 X |
| 4,209,194 | 6/1980 | Poe | 292/241 X |
| 4,220,364 | 9/1980 | Poe | 292/341.18 |
| 4,580,822 | 4/1986 | Fukumoto | 292/DIG. 31 X |

FOREIGN PATENT DOCUMENTS 1-157864 10/1989 Japan .

*Primary Examiner*—Richard E. Moore
*Attorney, Agent, or Firm*—Martin Smolowitz

[57] ABSTRACT

A ratchet type latch assembly, which can reliably lock a closing member to a stationary frame even if the relative positions of a lockable member and a latch member are shifted. The latch member is pivoted by a pivotal pin to rear end portions of a pair of bearing arms attached to a latch case. A pawl lever is pivoted by a pivotal pin to central portions of the bearing arms. The latch member has an arcuate edge formed on the side of its pivotal pin opposite its guide projection and about its pivotal pin, the arcuate edge being formed with a train of ratchets The pawl lever has its rear end portion provided with a check pawl latch for engagement and disengagement with respect to the ratchet train. The latch lever is urged against the pawl lever by a torsion spring. An operating handle is pivoted to a front plate member of the latch case, and can be lifted manually to release the latch member from the lockable member of the stationary frame.

3 Claims, 4 Drawing Sheets

RATCHET TYPE LATCH ASSEMBLY

BACKGROUND OF THE INVENTION

1. Field of the Invention

This invention relates to a latch assembly for locking a closing member such as a door or a lid to a box-like body or a stationary frame.

2. Prior Art

Japanese Utility Model Publication No. 157,864/1989 discloses a latch assembly, which comprises a latch case secured to a closing member and having a front plate member, bearing arm means projecting from the front plate member, a latch member pivoted by a pivotal pin to the bearing arm means and having on one side a guide projection for engagement and disengagement with respect to a lockable member on the side of a stationary frame, the guide projection having a stem portion thereof formed with a locking recess extending toward the pivotal pin, the lockable member being engaged and disengaged with respect to the locking recess, the latch member being provided on the side opposite the guide projection with an engagement projection, and a lock lever pivoted by a separate pivotal pin to the bearing arm means and having a free end provided with a lock projection for engagement and disengagement with respect to the engagement projection of the latch member, the latch member being rotationally urged toward an unlocked position by a torsion spring having a coil portion fitted on the pivotal pin, the lock lever, rotationally urged by a separate torsion spring having a coil portion fitted on the pivotal pin to maintain engagement between the engagement projection of the latch member and the lock projection of the lock member.

In this latch assembly, at the end of a closing operation of the closing member, the guide projection of the latch member is brought into contact with the lockable member of the stationary frame, and during further closing of the closing member latch member urged by the lockable member is rotated about the pivotal pin. When the lockable member is engaged in the locking recess to a predetermined extent, the lock projection of the lock lever is engaged with the engagement projection of the latch member, thus locking the closing member to the stationary frame. In this latch assembly, the latch member is provided with a single engagement projection. Therefore, the rotational angle of the latch member from the waiting position to the lock position is fixed.

Therefore, if the relative positions of the lockable member and latch member are shifted due to deformation or mounting position shift of a hinge coupling, the closing member to the stationary frame or a shift of the mounting position of a guide rail for the closing member or deformation of the lockable member, the closing operation of the closing member is over before the latch member is rotated for the predetermined rotational angle noted above, i.e., without the lockable member received in the locking recess to a sufficient extent. In such a case, defective or incomplete lock of the closing member would result.

SUMMARY OF THE INVENTION

An object of the invention is to provide a ratchet type latch assembly, with which a closing member can be reliably locked to a stationary frame even if the relative positions of lockable member and latch member are shifted due to some cause.

To attain the above and other objects of the invention, there is provided a ratchet type latch assembly, which comprises a latch case secured to a closing member and having a front plate member, a pair of bearing arms projecting from the rear surface of the front plate member, a latch member pivoted by a pivotal pin to rear end projections of said bearing arms, the latch member having on one side thereof a guide projection for engagement and disengagement with respect to a lockable member on the side of a stationary frame, said guide projection having a stem portion thereof formed with a locking recess extending toward the pivotal pin, the lockable member being engaged in and disengased from the recess, the latch member having an arcuate edge formed on the side opposite the guide projection and about the pivotal pin, the arcuate edge being formed with a plurarlity of ratchets, a pawl lever having an intermediate portion pivoted by a pivotal pin to central portions of the bearing arms, the pawl lever having a rear end portion thereof formed with a check pawl for engagement and disengagement with respect the ratchets, an operating handle having a stem portion pivoted by a pivotal pin to the plate member of the latch case, the front plate member having the rear side thereof provided with a hollow cylindrical portion, a connecting rod inserted in the hollow cylindrical portion and biased forwardly by a compression coil spring, the connecting rod having a driven front end portion projecting from the front end opening of the hollow cylindrical portion in contact with a driven stem portion of the operating handle, the connecting rod having a drive rear end portion projecting from the rear end opening of the hollow cylindrical portion and in contact with a drive front end projection of the pawl lever, a coil member fitted on the pivotal pin, the check pawl of the pawl lever being urged against the ratchets of the latch member by a torsion spring having one straight end portion in engagement with the guide projection of the latch member and the other straight end portion in engagement with the driven front end projection of the pawl lever.

With this structure according to the invention, the rotational angle, for which the latch member is rotated from the waiting position to the lock position, has a fixed redundancy corresponding to the circumferential dimension of the ratchet train. Thus, even if the relative positions of the lockable member and latch member are shifted, the latch member can be rotated sufficiently until the lockable member is engaged in the locking recess to a predetermined extent, thus ensuring reliable lock of the closing member to the satisfactory frame.

BRIEF DESCRIPTION OF THE DRAWINGS

The above and other objects, features and advantages of the invention will become apparent from the detailed description of the preferred embodiment when the same is read with reference to the accompanying drawings, in which.

DETAILED DESCRIPTION OF THE PREFERRED EMBODIMENT

Figure 1:
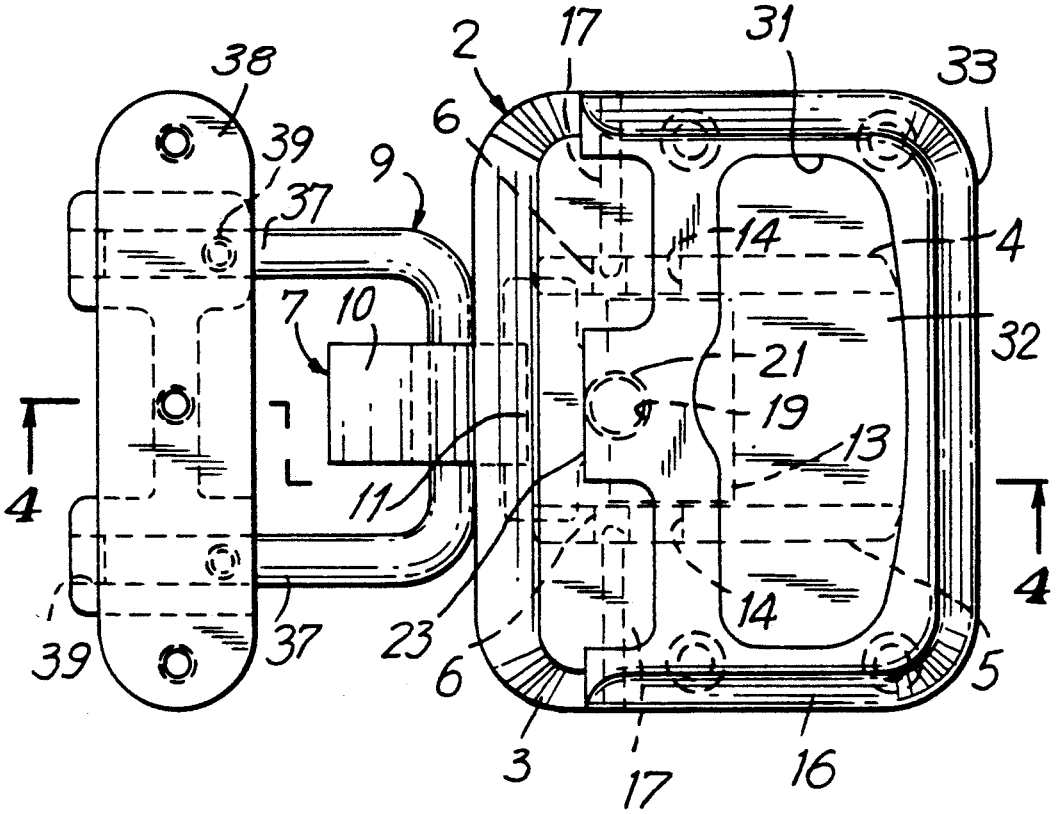
FIG. 1 is an elevational view showing an embodiment of the ratchet type latch assembly according to the invention in a locked state.
Figure 2:
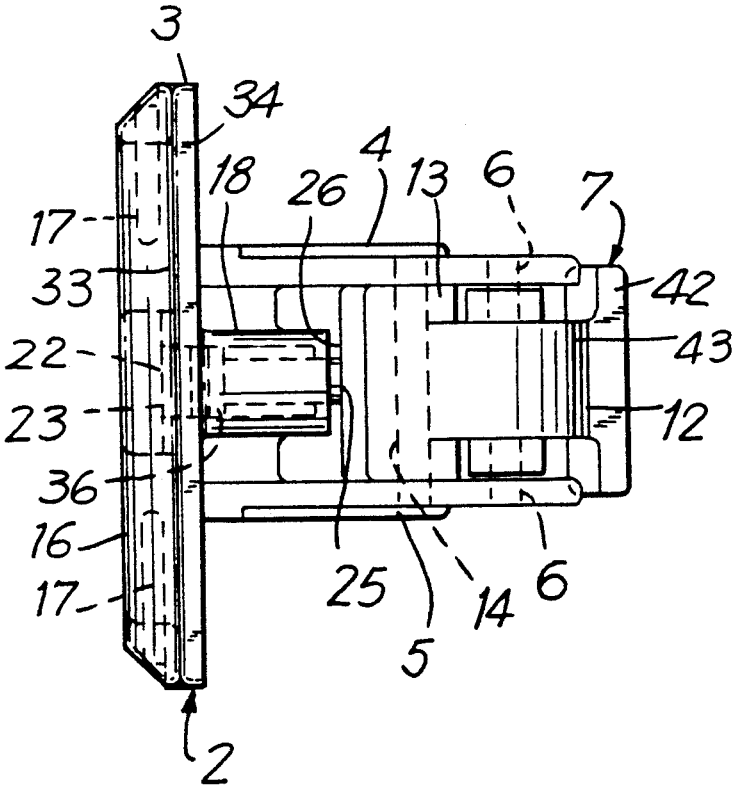
FIG. 2 is a right side view showing the same latch assembly.

The FIGS. 1–4 drawings illustrate an embodiment of the ratchet type latch assembly according to the invention. As illustrated, to a closing member 1 is secured a latch case 2, which has a front plate member 3. A pair of bearing arms 4 and 5 project from the rear surface of the front plate member 3. A latch member 7 is pivoted by a pivotal pin 6 to rear end portions of the bearing arms 4 and 5. The latch member 7 has on one side thereof a guide projection 10 for engagement and disengagement with respect to a lockable member 9 on one side of a stationary frame 8. The guide projection 10 has a stem portion thereof formed with a latching recess 11 extending toward the pivotal pin 6. The lockable member 9 is engaged in and disengaged from the locking recess 11. The latch member 7 has an arcuate edge formed on the side opposite the guide projection 10 and about the pivotal pin 6. The arcuate edge is formed with a plurality of ratches 12. A pawl lever 13 has an intermediate portion pivoted by a pivotal pin 14 to a central portions of the bearing arms 4 and 5. The pawl lever 13 has its rear end portion formed with a check pawl 15 for engagement and disengagement with respect to the ratchets 12.

Pivoted by a pivotal pin 17 to the front plate member 3 of the latch case 2 is a stem portion of an operating handle 16. The front plate member 3 has on its rear side a hollow cylindrical portion 18. A connecting rod 19 is inserted in the hollow cylindrical portion 18 and biased forwardly by a compression spring 20. The connecting rod 19 has a driven front end portion 22 projecting from the front end portion 21 of the hollow cylindrical portion 18 and in contact with a drive stem portion 23 of the operating handle 16. The connecting rod 19 has a drive rear end portion 25 projecting from the rear end opening 24 of the hollow cylindrical portion 18 and in contact with a driven front end projection 26 of the pawl lever 13. A coil member 28 is fitted on the pivotal pin 6. The check pawl 15 of the pawl lever 13 is urged against the ratchets 12 of the latch member by a torsional spring 27 having one straight end portion 29 in engagement with the guide projection 10 of the latch member 7, and the other straight end portion 30 in engagement with the driven front end projection 26 of the pawl lever 13.

Figure 4:
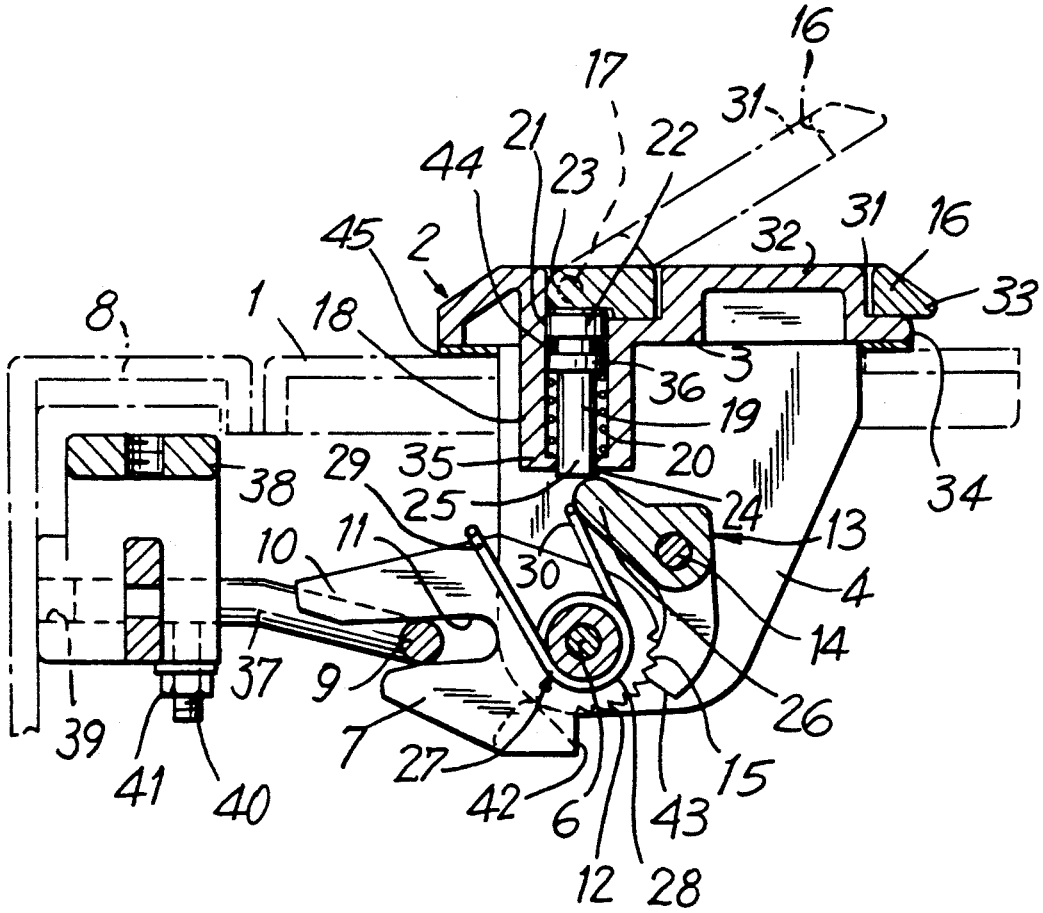
FIG. 4 is a sectional view taken along line 4—4 of FIG. 1.

As shown in FIG. 4, when the closing member 1 is locked to the stationary frame 8, the lockable member 9 is engaged in the locking recess 11 of the latch member 7 to a predetermined extent, the check pawl 15 of the pawl lever 13 is in engagement with the ratchet train 12 of the latch member 7, and this state of engagement is held by the biasing force of the torsion spring 27. The operating handle 16 is in its state thrown onto the front plate member 3 of the latch case 2, the connecting rod 19 is at its advanced set position, and the driven rear end portion 25 of the connecting rod 19 is in contact with the driven projection 26 of the pawl lever 13.

When the operating handle 16 is turned about the pivotal pin 17 and the drive stem portion 23 thereof pushes the driven front end portion 22 of the connecting rod 19, the connecting rod 19 is moved rearwardly against the biasing force of the compression coil spring 20, causing the driven rear end portion 25 of the connecting rod 19 to project from the rear end opening 24 of the hollow cylindrical portion 18 and push the driven projection 26 of the pawl lever 13. As a result, the pawl lever 13 is rotated about the pivotal pin 14 in the counterclockwise direction. The check pawl 15 of the pawl lever 13 is thus separated from the ratchet train 12 of the latch member 7.

In this state, by pulling the operating handle 16 toward the front, the guide projection 10 is pushed by the lockable member 9, causing rotation of the latch member 7 in the counterclockwise direction about the pivotal pin 6 in FIG. 4. Thus, the lockable member 9 is detached from the locking recess 11. The closing member 1 is thus released from the stationary frame 8, and the closing member 1 is opened. The guide projection 10 of the latch member 7 is held at an inclined waiting position, as shown by dotted lines in FIG. 3.

Figure 3:
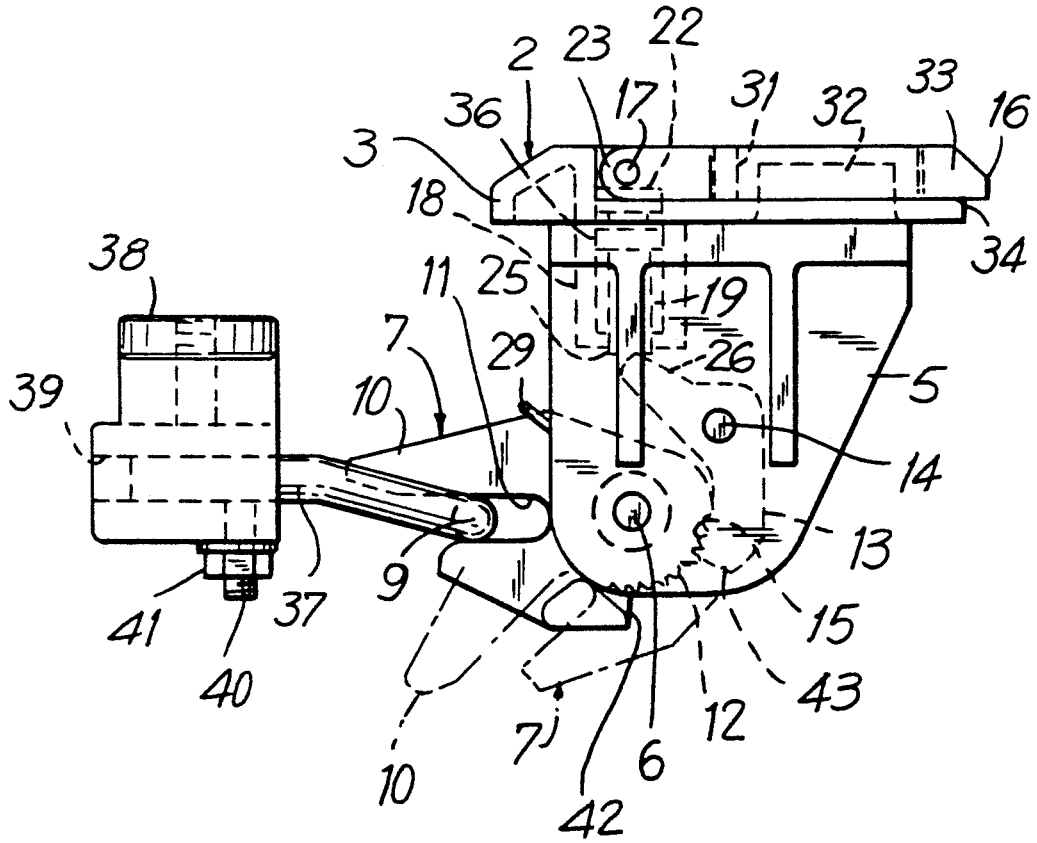
FIG. 3 is a bottom view showing the same latch assembly.

When closing the closing member 1, to the stationary frame 8, at the end of the closing operation the lockable member 9 pushes the guide projection 10, causing rotation of the latch member 7 in the clockwise direction about the pivotal pin 6 in FIG. 3. The lockable member 9 is thus engaged in the locking recess 11. During the clockwise rotation of the latch member 7, the check latch 15 of the pawl lever 13 is in frictional contact with the ratchet train 12 of the latch member 7. When the closing member 1 is completely closed with the lockable member 9 engaged in the locking recess 11 to a predetermined extent, the check latch 15 of the pawl lever 13 is engaged with the ratchet train 12 of the latch member 7. This state of engagement is held by the torsion spring 27.

In the illustrated embodiment, the latch case 2 is secured to the closing member 1 with its front plate member 3 disposed on the front side of the closing member 1, and the pair of, i.e., upper and lower, bearing arms 4 and 5 project from the rear surface of the front plate member 3 and closing member 1 at right angles thereto. The pivotal pin 6 of the latch member 7 and pivotal pin 14 of the pawl lever 13 extend parallel to each other and across the bearing arms 4 and 5. The hollow cylindrical portion 18 is made integral with the front plate member 3, and is located between the bearing arms 4 and 5 nearer the left end of the front plate member 3. A right half portion of the front plate member 3 has a raised portion 32, which is inserted in a finger insertion hole 31 of the operating handle 16 when the handle 16 is turned down. When the operating handle 16 is in its turned-down state, its end portion 33 projects from the right end 34 of the front plate member 3, thus facilitating the hooking of a finger on the operating handle 16 when erecting the same.

The compression coil spring 20 is interposed between a rear end wall 35 of the hollow cylindrical portion 18 and an outer peripheral flange 36 of the connecting rod 19, and the drive stem portion 23 of the operating handle 16 projects leftward from the pair, i.e., upper and lower, pivotal pins 17 as shown in FIG. 1. The drive pins 17 extend parallel to the pivotal pins 6 and 14. The lockable member 9 is a U-shaped rod, and after the insertion of its opposite legs 37 into a left and a right hole 39 of a holder 38 and the adjustment of the length of the projecting portions of the legs 37, it is secured to the holder 38 by a threaded stud 40 and a lock nut 41. The latch member 7 has a stopper shoulder 42 formed adjacent the ratchet train 12. When the latch member 7 is rotated to its released set position, a stopper face 43 of the pawl lever 13 at the rear end thereof is brought into contact with the stopper shoulder 42, thus holding the latch member 7 at a waiting open position thereof.

As has been described in the foregoing, with the ratchet type latch assembly according to the invention, the latch member 7 is pivoted by the pivotal pin 6 to the rear end portions of the bearing arms 4 and 5 of the latch case 2, the pawl lever 13 is pivoted by the pivotal pins 14 to central portions of the bearing arms 4 and 5, the latchet member 7 has its arcuate edge, which is formed on the side of the pivotal pin 6 opposite the guide projeciton 10, and formed with a plurality of ratchets 12, and the pawl lever 13 has its rear end portion provided with the check pawl 15 for engagement and disengagement with respect to the ratchet train 12. The rotational angle, for which the latch member is rotated from the waiting position to the lock position, is a fixed redundancy corresponding to the circumferential dimension of the ratchet train 12. Thus, even if the relative positions of the lockable member 9 and latch member 7 are shifted, the latch membe 7 can be rotated sufficiently until the lockable member 9 is engaged in the locking recess 11 to a predetermined extent. Thus, the closing member 1 can be reliably locked to the stationary frame 8.

What is claimed is:

1. A ratchet type latch assembly comprising a latch case secured to a closing member and having a front plate member, a pair of bearing arms projecting from the rear surface of said front plate member, a latch member located between said bearing arms and pivoted by a pivotal pin to rear end projections of said bearing arms, said latch member having on one side thereof a guide projection for engagement and disengagement with respect to a lockable member on the side of a stationary frame, said guide protection having a stem portion thereof formed with a locking recess extending toward said pivotal pin, said lockable member being engaged in and disengaged from said locking recess, said latch member having an arcuate edge formed on the side opposite said guide projection and about said pin, said arcuate edge formed with a plurality of ratchets, a pawl lever having an intermediate portion pivoted by a pivotal pin to central portions of the bearing arms, said pawl lever having a rear end portion thereof formed with a check pawl for engagement and disengagement with respect to said ratchets, an operating handle having a stem portion pivoted by a pivotal pin to said front plate member of said latch case, said front plate member having on the rear side thereof a hollow cylindrical portion, a connecting rod inserted in said hollow cylindrical portion and biased forwardly by a compression coil spring, said connecting rod having a driven front end portion projecting from the front end opening of said hollow cylindrical portion in contact with a drive stem portion of said operating handle, said connecting rod having a drive rear end portion projecting from the rear end opening of said hollow cylindrical portion and in contact with a driven front end projection of said pawl lever, a coil member fitted on said pivotal pin, said check pawl of said pawl lever being urged against said ratchets of said latch member by a torsion spring having one straight end portion in engagement with said guide projection of said latch member and the other straight end portion in engagement with said driven front end projection of said pawl lever, wherein said front plate member has a raised portion which extends upwardly to a central portion in said operating handle when the handle is turned down.

2. A ratchet type latch assembly according to claim 1, wherein said operating handle has an end which projects beyond the end of said front plate member.

3. A ratchet type latch assembly according to claim 1, wherein said latchable member is a U-shaped rod having its two legs adjustably attached into holes of a holder by dual lockable stud bolts.

* * * * *